US005174784A

United States Patent [19]

Penning

[11] Patent Number: 5,174,784

[45] Date of Patent: Dec. 29, 1992

[54] ELECTRICAL CONNECTION MEMBER FOR CONNECTING A WIRE-SHAPED ELECTRICAL CONDUCTOR

[75] Inventor: Cornelis Penning, Eindhoven, Netherlands

[73] Assignee: U.S. Philips Corporation, New York, N.Y.

[21] Appl. No.: 699,843

[22] Filed: May 14, 1991

[30] Foreign Application Priority Data

May 23, 1990 [NL] Netherlands ..... 9001191

[51] Int. Cl.[5] ..... H01R 4/24

[52] U.S. Cl. ..... 439/439; 439/441

[58] Field of Search ..... 439/438–441, 439/389, 842, 851

[56] References Cited

U.S. PATENT DOCUMENTS

| | | | |
|---|---|---|---|
| 2,713,668 | 7/1955 | Gibilisco | 439/441 |
| 4,084,876 | 4/1978 | Dinger | 439/439 |
| 4,576,429 | 3/1986 | Hardouin et al. | 439/441 |
| 4,768,976 | 9/1988 | Gelati | 439/441 |

FOREIGN PATENT DOCUMENTS

| | | | |
|---|---|---|---|
| 2802269 | 7/1979 | Fed. Rep. of Germany | 439/438 |

*Primary Examiner*—David L. Pirlot

*Attorney, Agent, or Firm*—Paul R. Miller

[57] ABSTRACT

A connection member (1) comprises an insulating housing (3) which includes a cavity (5) in which a contact element (11) can be arranged. A surface (9) of the housing (3) is provided with at least one wire insertion opening (7) which communicates with the cavity (5). The contact element (11) comprises an electrically conductive, flat contact member (15) and a flat bearing (17) which resiliently contact one another. The contact member (15) and the bearing (17) enclose an acute angle (33), thus forming an inlet opening (35) for receiving a wire-shaped electrical conductor (41). When the contact element (11) is arranged in the connection member (1), the inlet opening (35) faces the wire insertion opening (7). The connection member (1) also comprises a control member (13) which is adapted to remove a clamped wire without invoking damage from the connection member (1) by moving the contact member (15) and the bearing (17) apart. The contact member (15) and the bearing (17) are made from one piece of a conductive sheet material by way of punching and bending operations. The bearing (17) constitutes the resilient portion and for removal of the wire (41) it can be deflected by the control member (13) which is formed on the housing (3) and which exerts a force directed away from the contact member (15).

11 Claims, 4 Drawing Sheets

ELECTRICAL CONNECTION MEMBER FOR CONNECTING A WIRE-SHAPED ELECTRICAL CONDUCTOR

BACKGROUND OF THE INVENTION

The invention relates to an electrical connection member for connecting a wire-shaped electrical conductor, comprising:

a) an electrically insulating housing which includes a cavity which communicates with at least one wire insertion opening provided in a surface of the housing, and b) at least one contact element which is formed from one piece of electrically insulating sheet material and which comprises an electrically conductive flat contact member and a flat bearing which resiliently contact one another and enclose an acute angle, thus forming an inlet opening for receiving a wire-shaped conductor to be clamped between the contact member and the bearing, which contact element can be secured in the cavity of the housing by means of fixing means so that the inlet opening faces the wire insertion opening.

A connection member of this kind is known from the Patent Application DE-A 28 02 269 laid open to public inspection. The contact element used therein is formed from one piece of conductive sheet material by way of punching and bending operations. The described contact element comprises a contact member and a bearing. The contact member is resilient with respect to the bearing, so that upon insertion of a wire into the connection member the wire is clamped between the contact member and the bearing. This has a drawback in that an additional tool, for example a screw driver, is required for removing the wire from the contact element, which tool serves to move the contact member and the bearing apart so as to release the wire.

SUMMARY OF THE INVENTION

It is an object of the invention to provide a connection member of the kind set forth where a clamped wire can be simply removed from the contact element without requiring the use of additional tools and without incurring damage. To achieve this, the connection member in accordance with the invention is characterized in that the bearing constitutes the resilient portion which consists of a leaf spring, the housing being provided with at least one control member which is connected to the housing by way of an integral hinge and which is formed as a cam adapted to exert a force on the leaf spring near a free end thereof, which force is directed away from the contact member. Because the control member is integral with the housing, no additional tools are required for detaching a wire. It is to be noted that from U.S. Pat. No. 2,713,668 it is known per se to form the control member on the contact element, thus also avoiding the need for additional tools.

However, in some cases it is undesirable to use an electrically conductive material for constructing the control member because touching may be detrimental to the circuit, for example in the case of static charging. Therefore, in some cases it is desirable to avoid touching of the electrically conductive contact portion for control.

When the control member is constructed using the same insulating material as used for the housing, the effects of touching of the contact portion are avoided.

A preferred embodiment of the connection member is characterized in that at least one cam is provided with an opening wherethrough the contact member can be accessed by a test prod.

Tests can thus be simply performed directly on the contact member.

In order to render the contact member directly suitable for mounting in the housing without requiring additional tools, a further preferred embodiment of the contact member is characterized in that the fixing means are barbs formed on the contact element, the contact element being secured in the insulating housing by cooperation between the barbs and the wall of the housing.

An embodiment of the connection member which offers the advantage that excessive bending of the leaf spring is prevented is characterized in that at the side of the bearing which is remote from the contact member there is provided an abutment in the form of a strip-shaped portion bent out of the plane of the sheet. The strip-shaped portion can be formed without additional cost during the punching and bending operations.

An alternative version of the latter embodiment is characterized in that the plane of the strip-shaped portion extends approximately perpendicularly to the plane of the leaf spring.

BRIEF DESCRIPTION OF THE DRAWINGS

The invention will be described in detail hereinafter with reference to the drawing.

DESCRIPTION OF THE PREFERRED EMBODIMENTS

Figure 1:
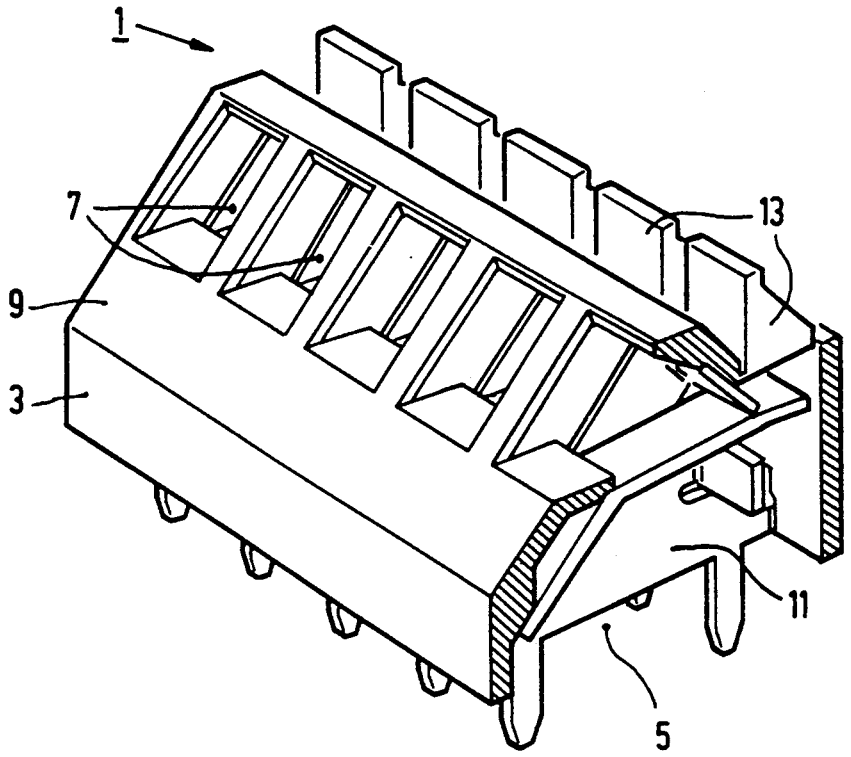
FIG. 1 is a partial perspective view of an embodiment of a connection member in accordance with the invention.

The connection member 1 shown in FIG. 1 comprises an insulating housing 3 which includes a cavity 5. The cavity 5 communicates with a number of wire insertion openings 7 provided in a surface 9 of the housing 3. Contact elements 11 to be described in detail hereinafter with reference to FIG. 2 can be accommodated in the cavity 5.

The connection member 1 also comprises a number of control members 13, each of which is adapted to remove a wire-shaped electrical conductor, secured in the contact element 11, from the connection member 1 without damaging the conductor. In the present embodiment the control members 13 are formed by cams which are made of the same insulating material as the housing 3, the connection between the housing 3 and a cam 13 consisting of an integral hinge. The insertion and removal of the wire-shaped conductor will be described in detail hereinafter with reference to the FIGS. 4*a*, 4*b* and 4*c*.

Figure 2:
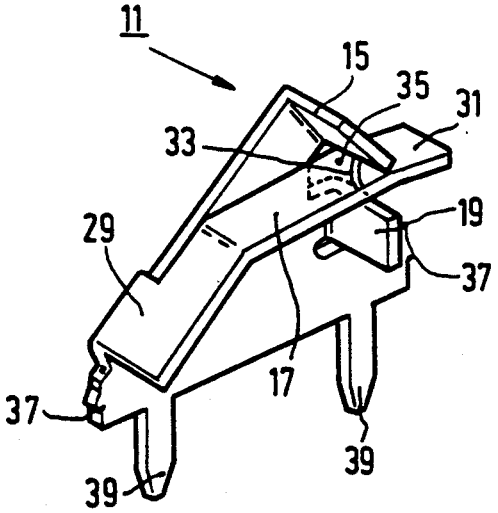
FIG. 2 is a perspective view of an embodiment of a contact element forming part of the connection member shown in FIG. 1, FIGS. 3*a*, 3*b* and 3*c* show some examples of the shape of a piece of sheet material after punching, which piece can be bent so as to form a contact member which fits in the housing.

FIG. 2 is a perspective view of a contact element 11. The contact element 11 can be formed from a single piece of electrically conductive sheet material by way of punching and bending operations.

Figure 3A:
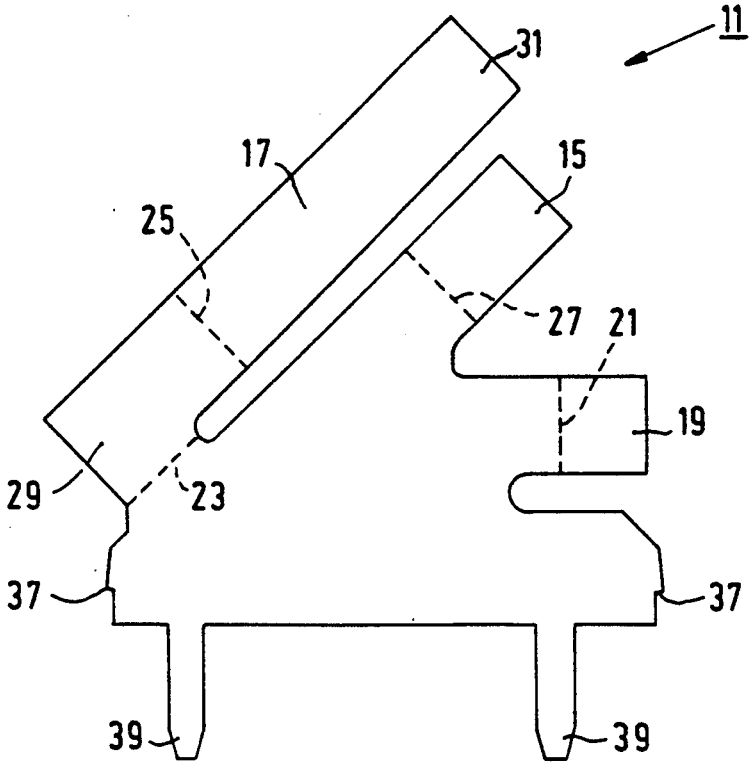

FIG. 3*a* shows the shape of a piece of sheet material obtained after the punching operation. The contact element 11 shown in FIG. 2 can be obtained by successively bending portions of the plate thus formed out of the plane of the plate according to the broken lines 21, 23, 25, 27.

The contact element 11 thus formed comprises a flat contact member 15, a flat bearing 17, and an abutment 19, the contact member 15 and the bearing 17 resiliently contacting one another. The bearing 17 consists of a leaf spring, one end 29 of which is integral with the contact element 11, the other (free) end 31 cooperating with the contact member 15. The contact member 15 and the bearing 17 enclose an acute angle 33, thus constituting an inlet opening 35 for receiving a wire-shaped electrical conductor. When the contact element 11 is arranged in the housing 3, the inlet opening 35 faces the wire insertion opening 7 in the housing 3. Fixing means 37 are also provided on the contact element 11. In the present embodiment, these means are shaped as barbs so that they can be readily realised during the punching operation. The contact element 11 is secured in the housing 3 by cooperation between the barbs 37 and the wall of the housing 3. The orientation of the barbs 37 is such that the contact member 11 can be comparatively readily inserted into the housing 3 from the lower side in FIG. 1, its removal requiring a comparatively large force. Each contact element 11 also comprises connection pins 39 whereby the connection member 1 can be secured, for example, to a printed circuit board.

Figure 3B:
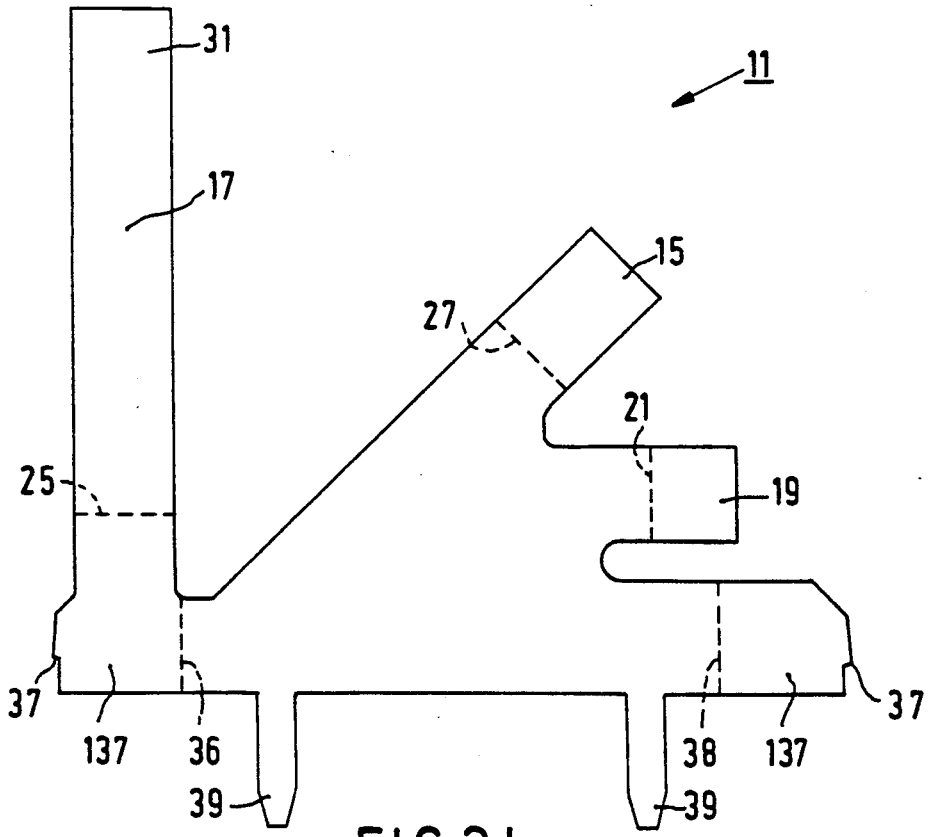
Figure 3C:
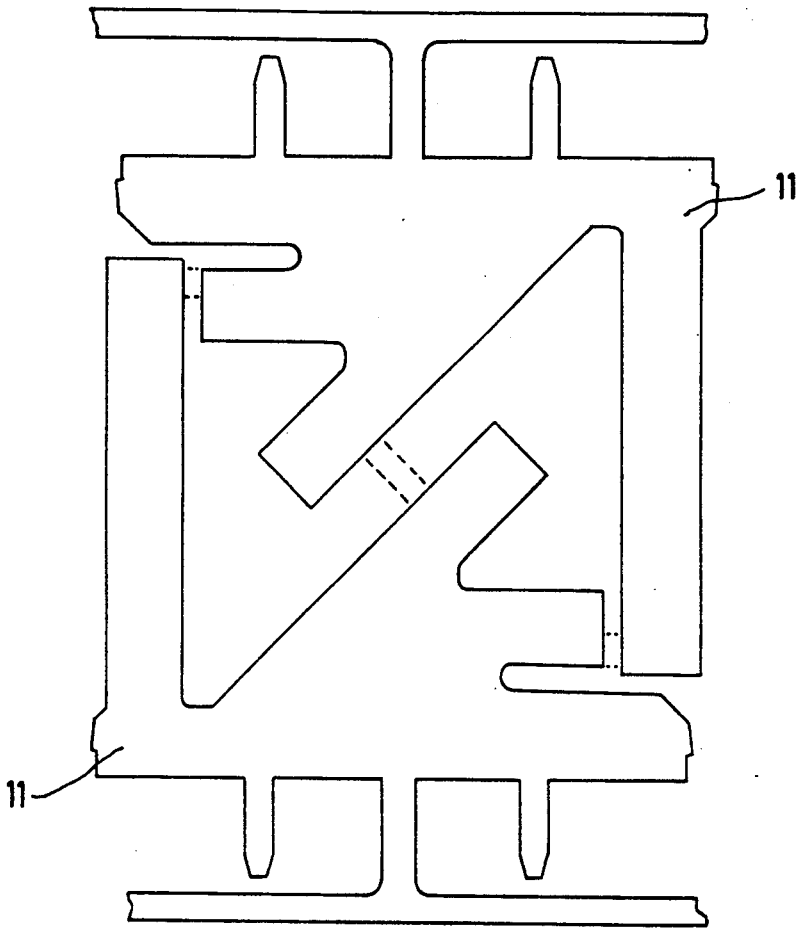

An alternative version of the embodiment of the contact member 11 shown in FIG. 2 can be realised from a piece of sheet material whose shape is shown in FIG. 3*b*. The portions 137 of the contact element 11 on which the barbs 37 are formed are bent approximately perpendicularly to the plane of the sheet according to the broken lines 36 and 38. Inclination of the contact member 11 after mounting in the housing 1 is thus prevented. This shape also has the advantage that little material is lost during the punching operation because, as is shown in FIG. 3*c*, the two contact elements 11 fit one into the other so that they can be formed substantially from a square piece of sheet material.

Figure 4A:
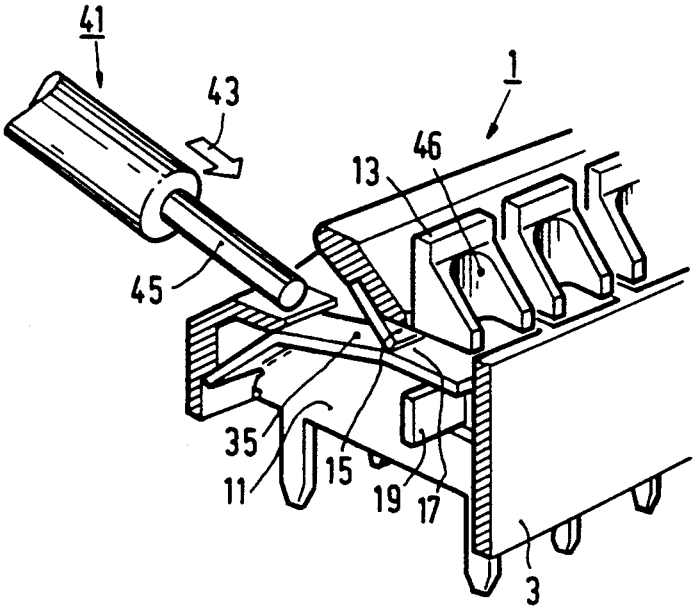
FIGS. 4*a*, 4*b* and 4*c* are partial perspective views of the connection member shown in FIG. 1, illustrating the insertion and removal of a wire-shaped electrical conductor.
Figure 4B:
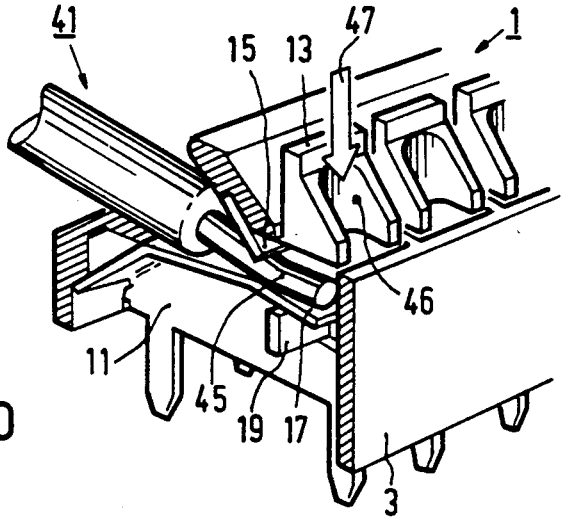
Figure 4C:
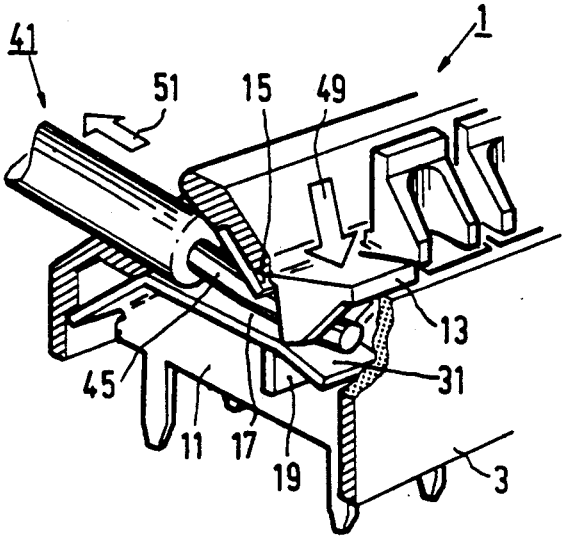

FIGS. 4*a*, 4*b* and 4*c* illustrate the insertion of a wire-shaped conductor 41 into the connection member 1 and its removal therefrom.

In FIG. 4*a* a conductor (wire) 41 is inserted into the inlet opening 35 of the connection member 1 via the wire insertion opening 7, in the direction of the arrow 43. FIG. 4*b* demonstrates that the non-insulated end 45 of the wire 41 is then clamped between the contact member 15 and the bearing 17 of the contact element 11. Due to the presence of the opening 46 which may be provided in a cam 13, tests can be performed, for example using a test prod (not shown), on the non-insulated end 45 of the wire 41. The test prod can be inserted into the opening 46 in the direction of the arrow 47. Without using additional tools, it is not possible to remove the wire 41 from the connection member 1 without invoking damage. This is because the contact member 15 would then penetrate the surface of the wire 41. This can be avoided by utilizing the cams 13. Each cam 13 can be moved in the direction of the arrow 49 (FIG. 4*c*), so that the cam or the free end 31 of the bearing 17 can exert a force which is directed away from the contact member 15, the contact member 15 and the bearing 17 thus being pressed apart. The wire 41 is then no longer clamped and can be removed in the direction of the arrow 41 without incurring any damage. In order to prevent the bearing 17, formed as a leaf spring, from being pressed too far when the wire is removed, an abutment 19 is formed on the contact element 11 during the punching and bending operations. The plane of the abutment 19 and the plane of the leaf spring 17 extend approximately perpendicularly to one another, so that the abutment cannot be moved downwards.

I claim:

1. An electrical connection member for connecting an electrical conductor, said connection member comprising:

a) an electrically insulative housing having a wall with a conductor insertion opening and a cavity which communicates with said conductor insertion opening;

b) a contact element disposed in said cavity for securing a conductor inserted through said insertion opening, said contact element being comprised of a single integral piece of electrically conductive sheet material and having a resilient bearing portion for supporting a length of inserted conductor and a substantially rigid contact portion arranged at an acute angle to said resilient bearing portion, said resilient bearing portion being resiliently biased against said contact portion for clamping a conductor between said bearing portion and said contact portion, wherein said bearing portion is comprised of a cantilevered arm of said sheet of material, and at the side of the bearing portion which is remote from the contact portion there is provided an abutment in the form of a strip-shaped portion bent out of the plane of the sheet; and c) an electrically insulative control member integrally hinged to said housing for biasing said resilient bearing portion away from said contact portion to release a conductor secured between said bearing and contact portions.

2. A connection member as claimed in claim 1, characterized in that the plane of the strip-shaped portion extends approximately perpendicularly to the bearing portion.

3. A connection member as claimed in claim 1, characterized in that said control member comprises an opening through which said contact portion can be accessed by a test prod.

4. A connection member as claimed in claim 3, characterized in that said contact element comprises barbs engageable with said housing for securing the contact element in the housing.

5. A connection member as claimed in claim 4, characterized in that said bearing portion is comprised of a cantilevered arm of said sheet of material, and at the side of the bearing portion which is remote from the contact portion there is provided an abutment in the form of a strip-shaped portion bent out of the plane of the sheet.

6. A connection member as claimed in claim 5, characterized in that the plane of the strip-shaped portion extends approximately perpendicularly to the bearing portion.

7. A connection member as claimed in claim 1, characterized in that said contact element comprises barbs engageable with said housing for securing the contact element in the housing.

8. A connection member as claimed in claim 7, characterized in that said bearing portion is comprised of a cantilevered arm of said sheet of material, and at the side of the bearing portion which is remote from the contact portion there is provided an abutment in the form of a strip-shaped portion bent out of the plane of the sheet.

9. A connection member as claimed in claim 8, characterized in that the plane of the strip-shaped portion extends approximately perpendicularly to the bearing portion.

10. A connection member as claimed in claim 3, characterized in that said bearing portion is comprised of a cantilevered arm of said sheet of material, and at the side of the bearing portion which is remote from the contact portion there is provided an abutment in the form of a strip-shaped portion bent out of the plane of the sheet.

11. A connection member as claimed in claim 10, characterized in that the plane of the strip-shaped portion extends approximately perpendicularly to the bearing portion.

* * * * *